US009688496B2

(12) United States Patent
Godfrey

(10) Patent No.: US 9,688,496 B2
(45) Date of Patent: Jun. 27, 2017

(54) MAT ROLLING APPARATATUS AND METHOD

(71) Applicant: Michael Davin Godfrey, Jacksonville, FL (US)

(72) Inventor: Michael Davin Godfrey, Jacksonville, FL (US)

( * ) Notice: Subject to any disclaimer, the term of this patent is extended or adjusted under 35 U.S.C. 154(b) by 0 days.

(21) Appl. No.: 14/873,639

(22) Filed: Oct. 2, 2015

(65) Prior Publication Data

US 2017/0096311 A1 Apr. 6, 2017

(51) Int. Cl.
*B65H 18/08* (2006.01)
*A63B 21/00* (2006.01)

(52) U.S. Cl.
CPC ..... *B65H 18/08* (2013.01); *A63B 21/4037* (2015.10)

(58) Field of Classification Search
CPC .... B65H 18/08; A63B 21/4037; B65D 35/32; Y10T 24/1408; Y10T 24/1498; Y10T 24/318
USPC ..... 242/579–584, 586, 587.2
See application file for complete search history.

(56) References Cited

U.S. PATENT DOCUMENTS 485,664 A * 11/1892 Schubert ..... B65H 75/406 144/51
761,751 A * 6/1904 Barrett ..... B65H 19/28 242/532.5
2,483,522 A * 10/1949 Bovee ..... B42D 19/00 242/156
2,656,069 A * 10/1953 Fogarty ..... B65D 35/28 222/103
2,737,353 A * 3/1956 Banks, Jr. ..... A47K 10/38 242/598.3
3,128,854 A * 4/1964 Specht ..... A45C 3/00 190/903
3,533,572 A * 10/1970 Sims ..... A47G 9/086 242/587.2
3,628,696 A * 12/1971 Duiker ..... B65D 35/32 222/99
3,877,092 A * 4/1975 Gaiser ..... A47C 27/084 5/413 R
4,008,863 A * 2/1977 Fohl ..... B60R 22/34 242/376
4,034,926 A * 7/1977 Wegner ..... B65D 85/672 206/406
4,120,242 A * 10/1978 Vosbikian ..... A45F 3/00 100/212
4,164,275 A * 8/1979 Davis ..... A45C 9/00 190/2
4,222,468 A * 9/1980 De Fries ..... A45C 9/00 190/102
4,272,575 A * 6/1981 Egigian ..... A45F 3/00 135/116
4,576,314 A * 3/1986 Elias ..... B65D 35/32 222/103

(Continued)

*Primary Examiner* — Emmanuel M Marcelo
*Assistant Examiner* — Michael Gallion
(74) *Attorney, Agent, or Firm* — The Concept Law Group, P.A.; Scott D. Smiley

(57) ABSTRACT

A mat rolling apparatus including a portable and tubular body defining a distal end and a proximal end, opposing the distal end, the body defining an open-faced channel, defined by a lower wall flanked by two side walls of the tubular body, spanning continuously and longitudinally from the distal end of the tubular body to the proximal end of the tubular body.

18 Claims, 8 Drawing Sheets

(56) References Cited

U.S. PATENT DOCUMENTS 4,817,823 A * 4/1989 Sparr, Sr. ..... B65D 35/28 222/103
4,873,009 A 10/1989 Anderson
4,911,347 A * 3/1990 Wilhite ..... A45F 3/14 224/251
4,957,246 A * 9/1990 Kantor ..... A47K 10/32 150/154
4,973,009 A * 11/1990 Dunlap ..... A47G 9/086 222/99
4,986,000 A * 1/1991 Mills ..... B65D 33/1666 30/2
5,058,771 A * 10/1991 Curtis ..... B65D 35/32 222/99
5,181,670 A * 1/1993 Eaton ..... B65D 85/18 206/296
5,184,361 A 2/1993 Canter et al.
5,210,891 A * 5/1993 Avital ..... A45C 3/10 224/156
5,303,874 A * 4/1994 Le Masters ..... B65B 63/04 242/405
5,347,671 A * 9/1994 Hunts ..... B65D 33/1675 24/30.5 R
5,558,250 A * 9/1996 Manders ..... B65D 35/32 222/100
D376,287 S * 12/1996 Bennett ..... D6/595
5,720,057 A * 2/1998 Duncan ..... A47C 27/001 5/420
5,775,625 A * 7/1998 Shimomura ..... B65H 49/205 242/125.3
5,841,069 A * 11/1998 Nagaoka ..... B60R 16/027 174/135
6,061,849 A * 5/2000 Seals ..... A47G 9/062 383/4
6,182,921 B1 * 2/2001 Muylle ..... B65H 75/185 242/118.61
6,192,554 B1 * 2/2001 Dumcum ..... B65D 63/1018 24/16 PB
6,202,951 B1 * 3/2001 Yamada ..... G11B 23/037 242/342
6,223,367 B1 * 5/2001 French ..... A45C 3/10 383/4
6,386,476 B1 * 5/2002 Adleman, Jr. ..... E04G 23/006 156/763
6,393,675 B1 * 5/2002 Gaetke ..... B65D 35/18 222/92
6,520,379 B1 2/2003 Campbell
6,561,385 B1 * 5/2003 Jacobs ..... B65D 35/32 222/103
6,751,816 B1 * 6/2004 Wechsler ..... A45F 3/14 383/4
7,007,322 B2 * 3/2006 Alane ..... A47G 27/0237 5/417
7,171,707 B2 * 2/2007 Landay ..... A47G 9/086 190/2
7,178,754 B2 * 2/2007 Anderson ..... A63H 27/002 242/402
7,213,278 B2 5/2007 Peterson et al.
7,243,875 B2 7/2007 Holub et al.
7,614,100 B1 * 11/2009 Barrington ..... A47G 9/062 383/4
7,971,763 B2 * 7/2011 Chace ..... A45F 3/02 224/153
8,769,742 B2 7/2014 Thornton
8,973,222 B2 * 3/2015 Breeden ..... B60P 7/083 24/68 CD
2005/0188461 A1 * 9/2005 Peterson ..... A47G 9/086 5/413 R
2008/0155792 A1 * 7/2008 Yeh ..... A44B 11/04 24/169
2010/0031447 A1 2/2010 Huang
2011/0272442 A1 * 11/2011 Che ..... B65H 35/10 224/191
2013/0012368 A1 * 1/2013 Verruto ..... A63B 21/00185 482/124
2013/0042408 A1 2/2013 Sun
2013/0105615 A1 * 5/2013 Guerin ..... E04D 15/06 242/580
2014/0069970 A1 * 3/2014 Thomas, Jr. ..... A45F 3/14 224/257
2014/0312999 A1 * 10/2014 Oomen ..... H01F 5/02 335/216
2015/0258363 A1 * 9/2015 Kampinski ..... A63B 21/4035 482/139

* cited by examiner

100

100

100

100

MAT ROLLING APPARATATUS AND METHOD

FIELD OF THE INVENTION

The present invention relates generally to an apparatus and method for rolling mats and, more particularly, relates to a removable apparatus for rolling and storing a yoga mat.

BACKGROUND OF THE INVENTION

Many individuals engage in exercises and workout regimes that involve portable mats. Whether employing mats for yoga, sit-ups, or other exercises users must (1) unroll and/or flatten the mat for use, (2) roll, fold, or otherwise manipulate the mat after use (hereinafter referred to generally as "rolling"), and (3) store the mat while not in use. For many users, rolling can be an undesirable time-intensive task. Further, after the mat is rolled, if it is done ineffectively, it takes up more space than required and can be difficult or cumbersome to handle. When a mat is ineffectively rolled, it is also prone to being damaged during transport and storage.

Some known apparatuses and methods of rolling a mat effectively include large and costly industrial equipment that is designed to produce a very tight coil of the mat. Besides being incapable of daily or repeated use by the consumer because of the industrial equipment's cost and size (i.e., they are designed for one-time use with a mat), these machines do not provide the user with the ability to store the mat effectively after the first use. Further, many of these devises are employed for use only with mats, carpets, or bags of a larger thickness, making them both structurally and operationally inapplicable for use with mats of a lower thickness, i.e., approximately 0.5-1.5" in thickness.

Some known apparatuses and methods of rolling and storing a floor mat include attaching, via adhesive or one or more rivets or other fasteners, rigid rectangular rolling members at the distal ends of the mat. These apparatuses and methods present many problems, as users are unable to use the rolling members with other mats. Further, the shape of the rolling members inhibits the user from forming a tight rollup. Additionally, to store or maintain the coiled mat in said configuration, the apparatuses employ a coupling mechanism that demands that one or more portions of the mat to which the coupling mechanism is coupled to be made out of a particular material, e.g., Velcro.

Additional known apparatuses and methods are designed specifically for rolling and storing sleeping bags, which creates many disadvantages for users when applied to mats, such as yoga mats. For example, many of these bag-rolling apparatuses employ two bars defining a slot in-between, wherein the slot is shaped and sized to receive a thick sleeping bag, which is generally of thickness ranging between 3-8". Because of this size limitation, the configuration of the two bars would generate a larger than desired diameter of a coiled mat. Further, because of the type of material used for sleeping bags, the width of the apparatus is sized to be larger than the width of the bag being rolled. This again is problematic for many users desirous to roll mats in an effective manner because the apparatus takes up more space than desired. Further, these known apparatuses also do not give the ability to store and transport the bag after being coiled. Lastly, because of size and/or the type of material used for sleeping bags, the manner in which the bags are retained and stored in their coiled position is ineffective or inapplicable for use with mats.

Therefore, a need exists to overcome the problems with the prior art as discussed above.

SUMMARY OF THE INVENTION

The invention provides a mat rolling apparatus and method that overcomes the hereinafore-mentioned disadvantages of the heretofore-known devices and methods of this general type and that provides users with the ability to effectively and efficiently roll/coil a mat, unroll or uncoil said mat, and store and transport said mat.

With the foregoing and other objects in view, there is provided, in accordance with the invention, a mat rolling apparatus with a portable and tubular body defining a distal end and a proximal end, opposing the distal end, wherein the tubular body defines an open-faced channel, defined by a lower wall flanked by two side walls of the tubular body, which spans continuously and longitudinally from the distal end of the tubular body to the proximal end of the tubular body.

In accordance with another feature, an embodiment of the present invention includes an elastic cord with a first end coupled to the tubular body at a location substantially adjacent to the distal end of the tubular body and a second free end opposite the first end of the cord, the second end of the cord having a loop disposed thereon.

In accordance with yet another feature, an embodiment of the present invention includes the cord having a cord length, defined by the first and second ends of the cord, and a cord width, defined by two opposing side edges of the cord spanning the cord length, wherein the cord width is less than a diameter of the channel and the cord length is less than a length of the tubular body defined by the proximal and distal ends of the tubular body.

In accordance with an additional feature, an embodiment of the present invention includes the tubular body also having an outer-most side face disposed at a distal end of the tubular body, wherein the first end of the elastic cord is coupled to the outer-most side face.

In accordance with a further feature of the present invention, the distal and proximal ends are terminal ends of the tubular body and the channel is of a cylindrical shape. In further embodiments, the two side walls of the tubular body define an arcuate shape, wherein the two side walls of the tubular body have two respective opposing upper edges defining an entrance aperture with a width spanning the from the distal end of the tubular body to the proximal end of the tubular body, the width of the entrance aperture is less than a diameter of the channel. Additionally, the channel may include a diameter no greater than 1.5".

In accordance with the present invention, a method of coiling and retaining a mat is disclosed that includes the steps of (1) providing a portable and tubular body defining a distal end, a proximal end, the tubular body defining an open-faced channel, defined by a lower wall flanked by two side walls of the tubular body, spanning from the distal end of the tubular body to the proximal end of the tubular body, (2) providing a mat with a first end, a second end opposing the first end of the mat, and two lateral side edges separating the first and second ends of the mat, (3) inserting the first end of the mat into the open-faced channel until it reaches the lower wall, and (4) coiling the mat while the first end of the mat is disposed within the open-faced channel to generate a coiled mat with a coiled first side and a coiled second side opposing the coiled first side.

In accordance with another feature, when the mat includes an elastic cord with a first end coupled to the distal end of the tubular body and a second free end with a loop, the method also includes in one embodiment retaining the coiled mat by displacing the cord around the coiled first side of the coiled mat and inserting the coiled second side of the coiled mat into the loop.

In accordance with yet another feature, an embodiment of the present invention includes coiling the mat while the first end of the mat is disposed within the open-faced channel to generate the coiled mat defining a wound position with the second end of the mat in an overlapped configuration with the first end of the mat and retaining the coiled mat by placing the cord proximal to the second end of the mat.

In accordance with an another exemplary feature, an embodiment of the present invention includes inserting the first end of the mat into the open-faced channel, wherein a tubular body length separating proximal and distal ends of the tubular body is less than a mat width defined by the two lateral side edges of the mat.

In accordance with a further feature of the present invention, a mat rolling apparatus is disclosed that includes a portable and tubular body defining a distal end and a proximal end, opposing the distal end, the tubular body defining an open-faced channel, defined by a lower wall flanked by two side walls of the tubular body, spanning longitudinally from the distal end of the tubular body to the proximal end of the tubular body; and an elastic cord with a first end coupled to the tubular body at a location substantially adjacent to the distal end of the tubular body and a second free end opposite the first end of the cord, the second free end of the cord having a loop disposed thereon.

In accordance with an additional feature, an embodiment of the present invention includes the tubular body having a distal opening defined by the terminal distal end of the tubular body and a proximal opening defined by the terminal proximal end of the tubular body, wherein the channel spans from the distal opening to the proximal opening.

Although the invention is illustrated and described herein as embodied in a mat rolling apparatus, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the mat rolling apparatus.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
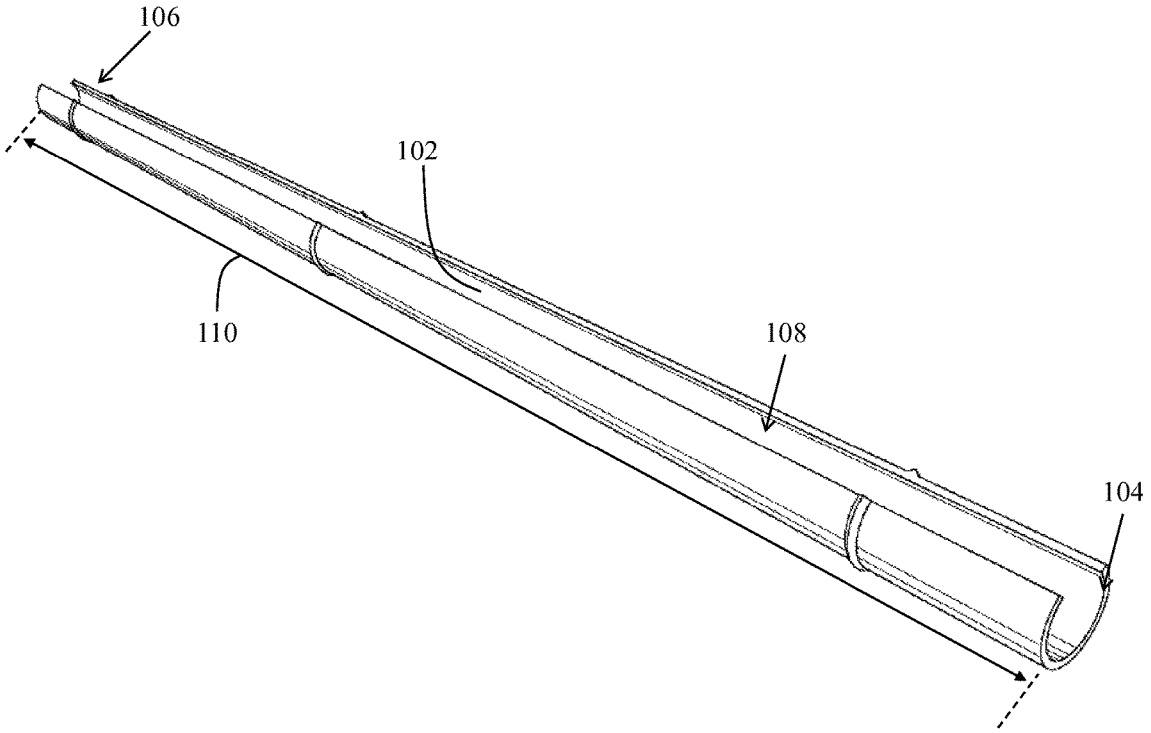
FIG. 1 is an isometric view of a mat rolling apparatus in accordance with the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient mat rolling apparatus and method that enables users to roll/unroll a mat quickly and effectively, thereby saving space and time associated with those known rolling apparatus. Embodiments of the invention also provide an effective and efficient apparatus and method of retaining and transporting the mat in its coiled position.

Referring now to FIG. 1, one embodiment of the present invention is shown in an elevational view. FIG. 1 shows several advantageous features of the present invention, but, as will be described below, the invention can be provided in several shapes, sizes, combinations of features and components, and varying numbers and functions of the components. The first example of a mat rolling apparatus 100, as shown in FIG. 1, includes a tubular body 102 that can be said to be portable in that it is capable of being easily carried or moved by user with his or her body, and without the use of machinery, equipment, or other external devices. The body 102 can also be said to be handheld, or capable of being held solely with one or more of the user's hands. The body 102 can be seen defining a proximal end 104 and a distal end 106 that opposes the proximal end 104. The ends 104, 106 may be the terminal end of the body 102, or may be some position disposed adjacent to the terminal end of the body, i.e., a distance within 20% of the total length of the body 102.

Figure 2:
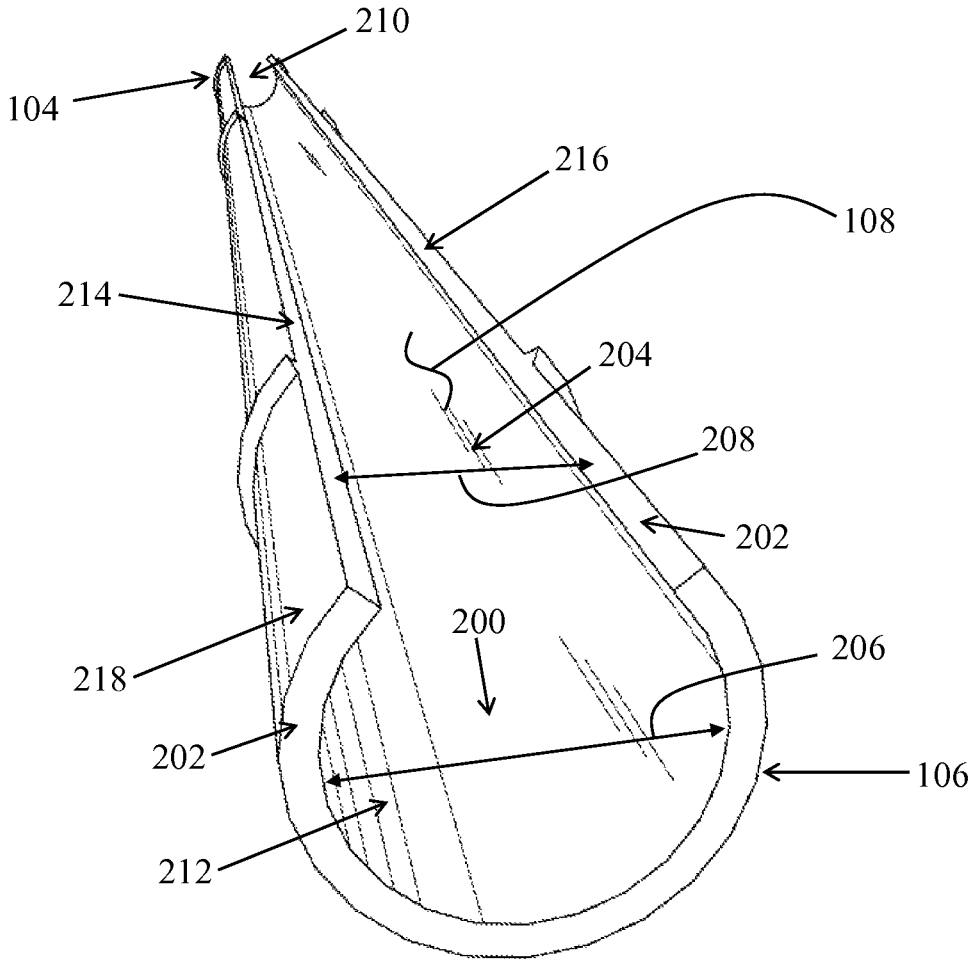
FIG. 2 is a perspective downward-looking view of the apparatus depicted in FIG. 1.

With reference to FIGS. 1 and 2, the body 102 is advantageously "tubular" in that it is of a cylindrical shape and includes the open-faced channel 108 as further described below. The tubular body 102 defines an open-faced channel 108. Specifically, the open-faced channel 108 can be seen defined by a lower wall 200 flanked by two side walls 202 of the tubular body 102. As shown in FIG. 2, the walls 200, 202 provide resistance against an edge of a mat inserted within the channel 108 so as to ensure a tight and taut coil. To facilitate in this resistance, the walls 200, 202 may be substantially free of any apertures sized to permit the mat from exiting the body 102 at an area other than the entrance 204 into the channel 108. Again, to effectuate generating a tight coil of the mat, the channel 108 and entrance 204 may span continuously and longitudinally from the proximal end 104 of the tubular body 102 to the distal end 106 of the tubular body 102. The tubular body 102 may be a substantially rigid material such as cast or extruded PVC with a hardness of approximately at least Shore 20 D or another polymer-based material. In other embodiments, the body 102 may be made of wood, bamboo, a composite material, a metallic material, or a ceramic material.

The channel 108 can be seen of a cylindrical shape or a "cylinder-shaped" configuration such as a "right circular cylinder," an "elliptic cylinder," or another oblong or elongated geometric shape that facilitates the effective receipt and retention of the mat as described herein. The channel 108 may also be of a rectangular or other shape. In one embodiments, the channel 108 has a diameter 206 (the largest distance that can be formed between two opposite parallel lines tangent to its boundary) of approximately 7/16-2.5", with a preferable diameter 206 of ½", and has a total length 110 of approximately 8-24", with a preferable length 110 of 22". The entrance aperture 204 has a width 208 slightly less than the diameter 206 of channel 108, preferably of approximately 5/16". The aforementioned lengths or widths may vary outside of the amounts or ranges, so as to continue to achieve one of the purposes described herein, i.e., to form a tight coil of and receive and/or retain the mat.

The body 102 may have a distal opening 212 defined by the distal or terminal distal end 106 of the tubular body 102 and a proximal opening 210 defined by the proximal or terminal proximal end 104 of the tubular body 102, wherein the channel 108 and entrance aperture 204 span from the distal opening 212 to the proximal opening 210. This not only advantageously permits the user to retain the mat after receipt, but it also permits the body 102 to effectively receive the mat by sliding it through one of the openings 210, 212.

In addition to the channel 108 and entrance aperture 204, the body 102 may also facilitate effective and efficient retention and receipt of the mat by forming an arcuate shape (as shown in FIG. 2) with the two side walls 202 of the tubular body 102. Specifically, the two side walls 202 of the tubular body 102 can be seen having an arcuate shape terminating into two respective opposing upper edges 214, 216 defining the entrance aperture 204 with the width 208 spanning the from the distal end 106 to the proximal end 104. The arcuate shape of the walls 200, 202, specifically the outer surface 218 of the walls, facilitates in the generation of a tight coil of the mat. The width 208 of the entrance aperture 204 being less than the diameter 206 of the channel 108 also facilitates in the retention of the mat when it is inserted therein.

Figure 3:
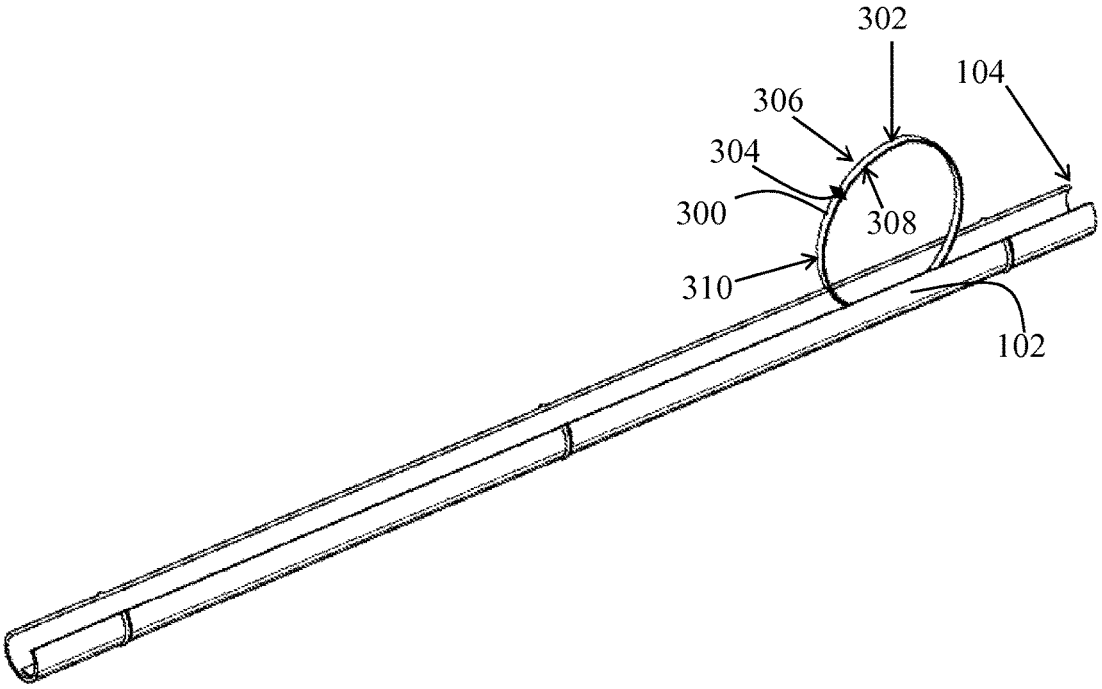
FIG. 3 is a perspective downward-looking side view of the apparatus depicted in FIG. 1 with an elastic cord in accordance with an embodiment of the present invention.
Figure 4:
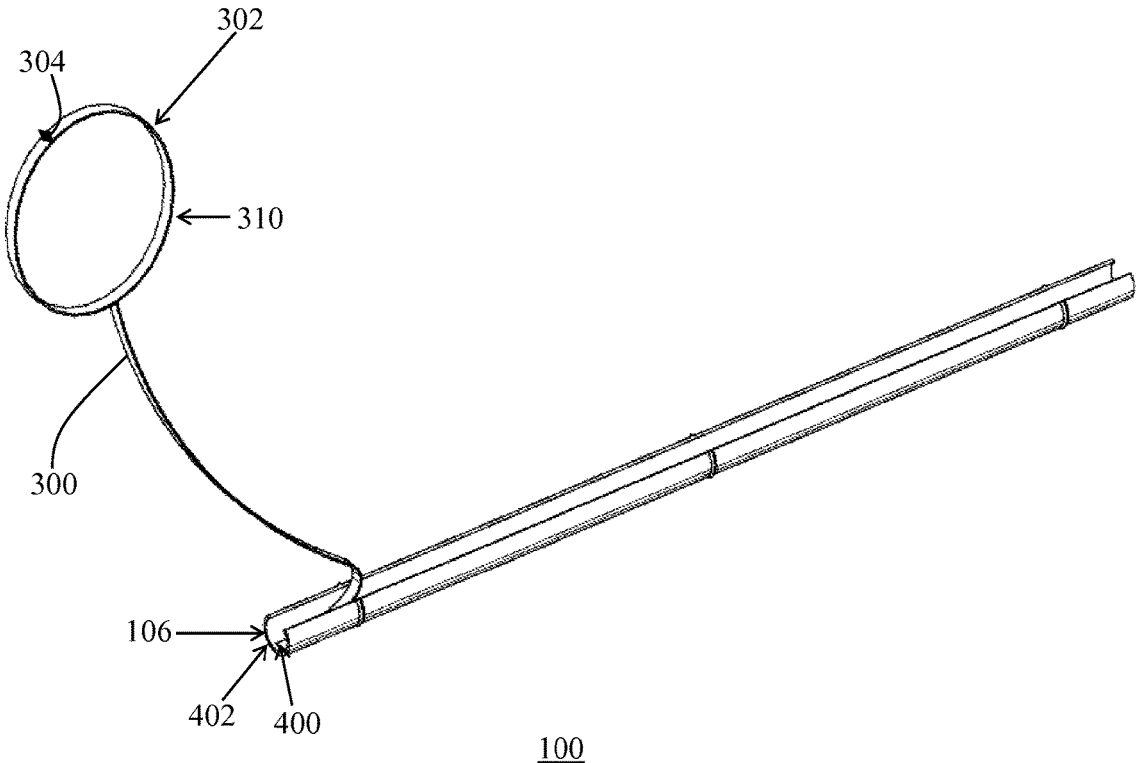
FIG. 4 is another perspective downward-looking side view of the apparatus depicted in FIG. 4.

With reference now to FIGS. 3-4, another advantageous feature of the present invention is depicted. Specifically, the apparatus 100 may also include an elastic cord 300 with a first end 400 coupled to the tubular body 102 at a location substantially adjacent to the distal end 106 of the tubular body 102 and a second free end 302 opposite the first end 400 of the cord 300. The second end is "free" in that it isn't directly fastened to an object and operable to be manipulated for omnidirectional movement. The second end 302 of the cord 300 having a loop 310 disposed thereon. The term "substantially adjacent" is defined as being side-by-side a referencing object or within approximately 2-3 inches from said referencing object. The elastic cord 300 provides an effective and efficient structure to retain the mat in the coiled position after it is rolled or coiled. As such, the mat is less prone to be being damaged from transport and storage. Without a portion of the elastic cord 300 coupled to the body 102, the apparatus 100 may utilize an enclosed elastic loop or Velcro strap in order to retain the mat in the coiled position.

The elastic cord 300 may be of a natural rubber, nylon, or another elastomer. In other embodiments, the cord 300 may be inelastic, e.g., fabric or hemp. The elastic cord 300, which may be of a generally elongated shape, may be also sized and shaped to be received within the diameter 206 of the channel 108 of the body 102. In preferred embodiments, the elastic cord 300 may be sized and shaped to be fully recessed within the channel 108 of the body 102 so it is not likely to be damaged when the apparatus 100 is not in use. Moreover, the cord 300 may have a cord length defined by the first and second ends 400, 302 of the cord 300 and a cord width 304, defined by two opposing side edges 306, 308. The cord width 304 spans the cord length and may be less than a diameter 206 of the channel 108 and the cord length is less than a length 110 of the tubular body 102. This dimensional configuration of the cord 300 provides the user the unique ability to effectively store and transport an apparatus 100 that not only can be used to roll a mat in a tight coil, but also effectively and efficiently retain that coiled mat.

In one embodiment, the first end 400 of the cord is coupled substantially adjacent to the distal end 106 of the body 102. In other embodiments, to ensure the distal edge of the mat has a flush configuration with the body 102 when inserted within the channel 108, the first end 400 of the cord 300 is coupled to the outer-most side face 402 disposed at the distal end 106 of the tubular body 102.

Figure 5:
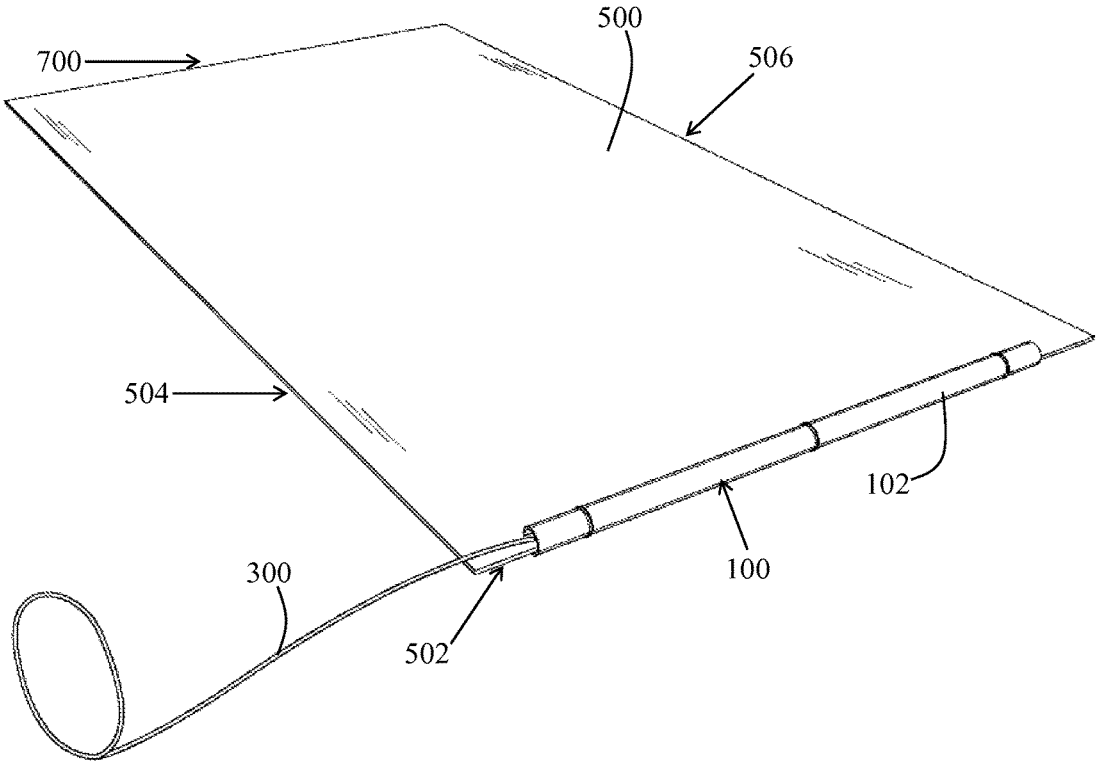
FIG. 5 is a perspective downward-looking view of the apparatus of FIG. 1 used in connection with a floor mat in accordance with one embodiment of the present invention.
Figure 6:
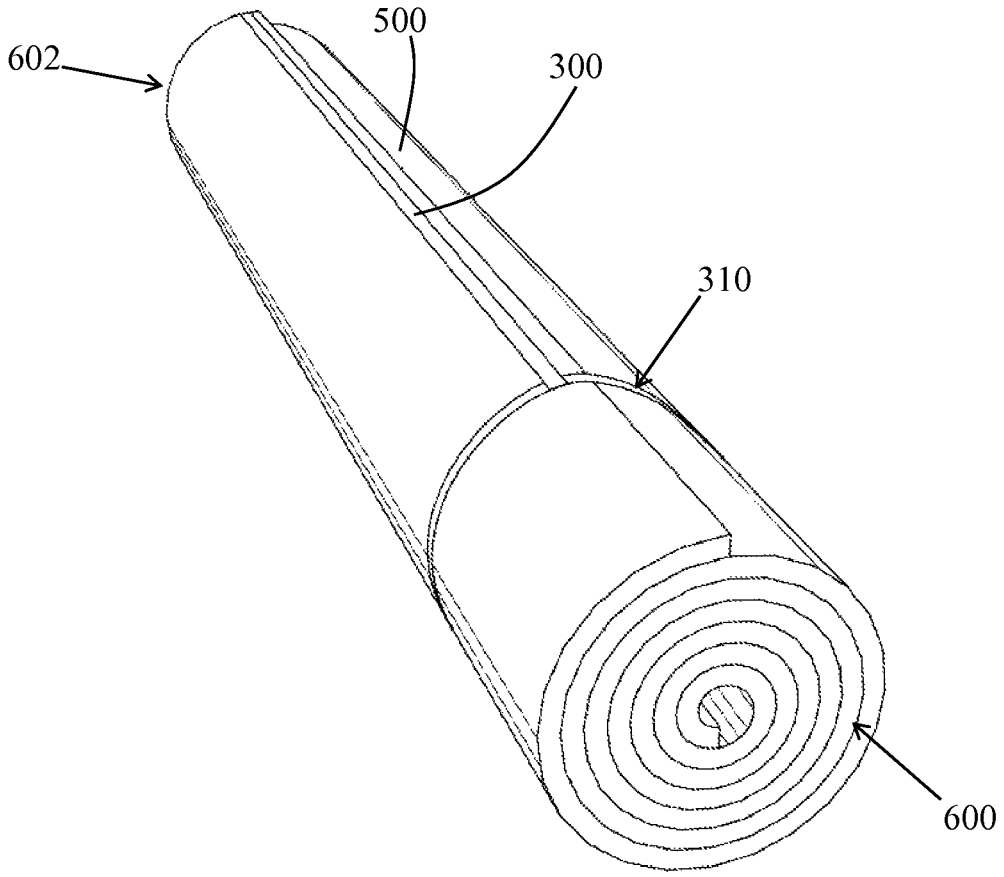
FIG. 6 is a perspective downward-looking rear view of the apparatus of FIG. 1 and mat of FIG. 5 in a coiled position.
Figure 7:
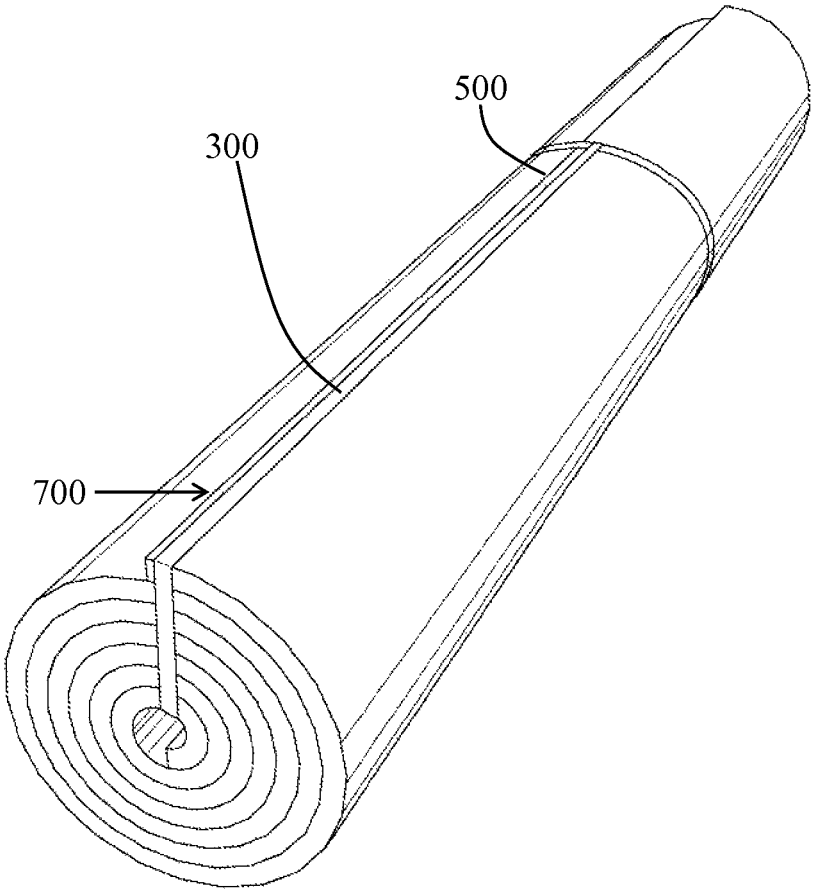
FIG. 7 is a perspective downward-looking front view of the apparatus of FIG. 1 and mat of FIG. 5 in the coiled position.
Figure 8:
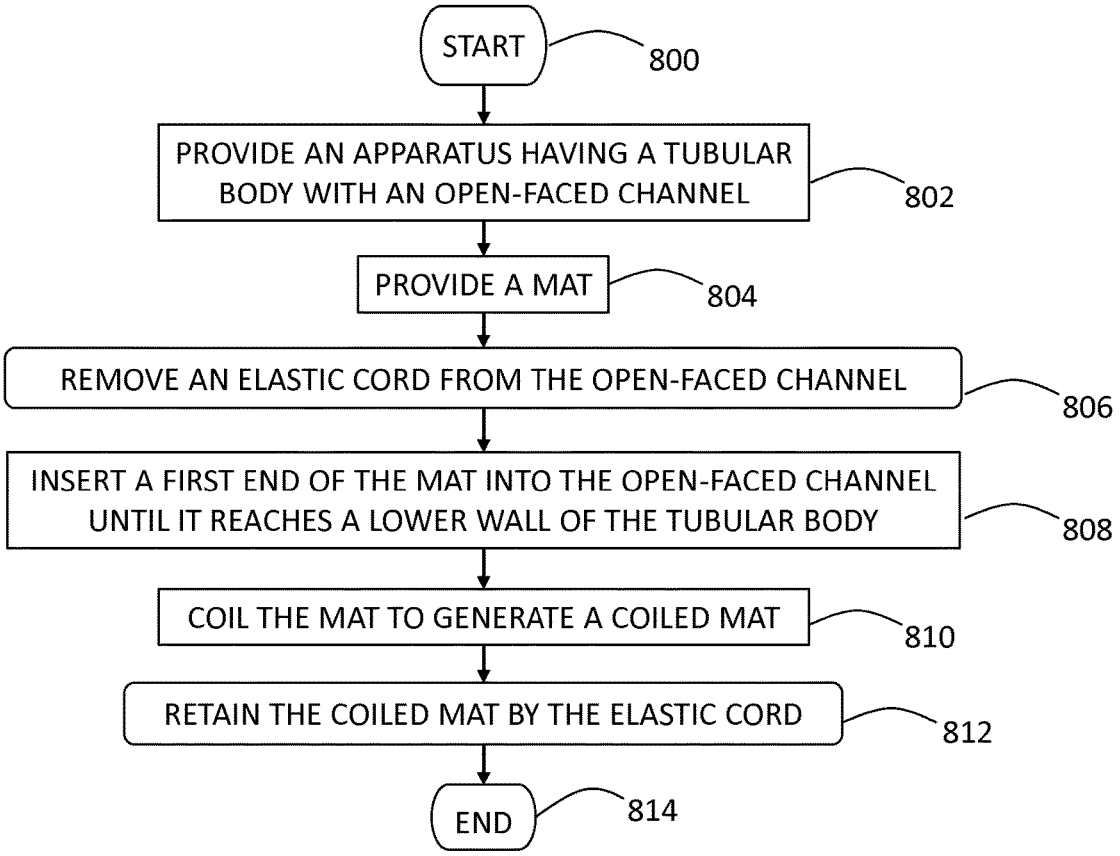
FIG. 8 is a process flow diagram depicting a method of coiling and retaining a mat in accordance with the present invention.

With reference to the process-flow diagram depicted in FIG. 8, in connection with FIGS. 5-7, a method of coiling and retaining a mat is 500 disclosed. The process starts at step 800 and immediately proceeds to the step 802 of providing a portable and tubular body 102 as described above. The tubular body 102 has an open-faced channel for insertion of the mat 500. Next, step 804 includes providing the mat with a first end 502, a second end 700 opposing the first end 502 of the mat 500 (when in a substantially planar or unrolled position), and two lateral side edges 504, 506 separating the first and second ends 502, 700 of the mat 500.

In one embodiment, the process continues to step 806 which includes, should the apparatus 100 have an elastic cord 300 coupled thereto and recessed within the channel, removing the elastic cord 300 from the open-faced channel. After step 806, step 808 includes inserting the first end 502 of the mat 500 into the open-faced channel until it reaches the lower wall of the body 102. Because the cross-sectional circumference of the body 102 is relatively small and the material from the mat 500 is not permitted to exit the body 102, a tight coil is effectuated when the mat is rolled around the body 102. As such, step 810 includes coiling the mat 500 while the first end 502 is disposed within the open-faced channel to generate a coiled mat with a coiled first side 600 and a coiled second side 602 opposing the coiled first side 600. To prevent the apparatus 100 from projecting outwardly from the first and second sides 600, 602, the body 102 can advantageously be seen of a length 110 less than the width of the mat 500 separating the side edges 504, 506.

Specifically, FIGS. 6-7 depict the mat 500 in a coiled position, i.e., a coiled mat, along a mat-coiling translation path. While predominantly the mat 500 may be placed in the mat-coiling translation path by rolling the mat, other embodiments may include folding or other methods. It can be seen that the apparatus 100 of the present invention generates a very quick and tight coil of the mat 500 when compared to those known rolling apparatuses.

The process may continue to step 812 of retaining the coiled mat 500 by displacing the cord 300 around the coiled first side 602 of the coiled mat 500 and inserting the coiled second side 600 of the coiled mat 500 into the loop 310 formed by cord 300. In some embodiments, the mat 500 is coiled while the first end 502 of the mat 500 is disposed within the open-faced channel 108 to generate the coiled mat 500 defining a wound or coiled position along a translation path, wherein the second end 700 of the mat 500 in an overlapped configuration with the first end 502 of the mat 500. When in the wound position, the coiled mat 500 may be retained by placing the cord 300 proximal to, within approximately 1-1.5" of, the second end 700 of the mat 500 as shown in FIG. 7. Said another way, after the mat is coiled, the cord 300 spans the longitudinal length of the coiled mat 500 adjacent to the second end 700 so that the second end 700 is not loose. When the mat 500 is desired for re-use, the user displaces the elastic cord 300 and quickly unrolls the mat 500 to a substantially planer configuration without any creases or other damage to the mat 500 caused by those known devices. The process terminates at step 814.

A mat rolling apparatus and method has been disclosed that provides a novel and efficient mat rolling apparatus and method that enables users to roll/unroll a mat quickly and effectively, thereby saving space and time associated with those known rolling apparatus. The present invention also provides an effective and efficient apparatus and method of retaining and transporting the mat after it is placed in its coiled position.

What is claimed is:

1. A mat rolling apparatus comprising:

a portable and tubular body defining a distal end and a proximal end, opposing the distal end, the tubular body defining an open-faced channel, defined by a lower wall flanked by two side walls of the tubular body, spanning continuously and longitudinally from the distal end of the tubular body to the proximal end of the tubular body, the lower wall and two side walls rigidly coupled to one another; and an elastic cord with a first end coupled to the tubular body at a location substantially adjacent to the distal end of the tubular body and a second free end opposite the first end of the cord, the second end of the cord having a loop disposed thereon sized to receive and retain a mat in a coiled orientation.

2. The mat rolling apparatus according to claim 1, wherein the cord further comprises:

a cord length, defined by the first and second ends of the cord, and a cord width, defined by two opposing side edges of the cord spanning the cord length, the cord width less than a diameter of the channel and the cord length less than a length of the tubular body defined by the proximal and distal ends of the tubular body.

3. The mat rolling apparatus according to claim 1, wherein the tubular body further comprises:

an outer-most side face disposed at the distal end of the tubular body, wherein the first end of the elastic cord is coupled to the outer-most side face.

4. The mat rolling apparatus according to claim 1, wherein:

the distal and proximal ends are terminal ends of the tubular body.

5. The mat rolling apparatus according to claim 1, wherein:

the channel is of a cylindrical shape.

6. The mat rolling apparatus according to claim 1, wherein:

the two side walls of the tubular body define an arcuate shape, the two side walls of the tubular body having two respective opposing upper edges defining an entrance aperture with a width spanning the from the distal end of the tubular body to the proximal end of the tubular body, the width of the entrance aperture less than a diameter of the channel.

7. The mat rolling apparatus according to claim 1, wherein:

the channel includes a diameter no greater than 1.5".

8. A method of coiling and retaining a mat comprising the steps of:

providing a portable and tubular body defining a distal end, a proximal end, the tubular body defining an open-faced channel, defined by a lower wall with two opposing sides directly coupled, respectively, to two side walls of the tubular body, spanning from the distal end of the tubular body to the proximal end of the tubular body; and the tubular body including an elastic cord with a first end coupled to the distal end of the tubular body and a second free end with a loop;

providing a mat with a first end, a second end opposing the first end of the mat, and two lateral side edges separating the first and second ends of the mat;

inserting the first end of the mat into the open-faced channel until it terminates at the lower wall;

coiling the mat while the first end of the mat is disposed within the open-faced channel to generate a coiled mat with a coiled first side and a coiled second side opposing the coiled first side; and retaining the coiled mat by displacing the cord along the coiled first side of the coiled mat and inserting the coiled second side of the coiled mat into the loop.

9. The method according to claim 8, further comprising:

retaining the coiled mat by placing the cord proximal to the second end of the mat, the coiled mat defining a wound position with the second end of the mat in an overlapped configuration with the first end of the mat.

10. The method according to claim 8, wherein:

a tubular body length separating proximal and distal ends of the tubular body is less than a mat width defined by the two lateral side edges of the mat.

11. A mat rolling apparatus comprising:

a portable and tubular body defining a distal end and a proximal end, opposing the distal end, the tubular body defining an open-faced channel, defined by a lower wall with two opposing sides directly coupled, respectively, to two side walls of the tubular body, spanning longitudinally from the distal end of the tubular body to the proximal end of the tubular body; and an elastic cord with a first end coupled to the tubular body at a location substantially adjacent to the distal end of the tubular body and a second free end opposite the first end of the cord, the second free end of the cord having a loop disposed thereon sized to receive and retain a mat in a coiled orientation.

12. The mat rolling apparatus according to claim 11, wherein the cord further comprises:

a cord length, defined by the first and second ends of the cord, and a cord width, defined by two opposing side edges of the cord spanning the cord length, the cord width less than a diameter of the channel and the cord length less than a length of the tubular body defined by the proximal and distal ends of the tubular body.

13. The mat rolling apparatus according to claim 11, wherein the tubular body further comprises:

an outer-most side face disposed at the distal end of the tubular body, the first end coupled to the outer-most side face.

14. The mat rolling apparatus according to claim 13, wherein:

the distal and proximal ends are terminal ends of the tubular body.

15. The mat rolling apparatus according to claim 14, wherein the tubular body further comprises:

a distal opening defined by the distal end of the tubular body and a proximal opening defined by the proximal end of the tubular body, the channel spanning from the distal opening to the proximal opening.

16. The mat rolling apparatus according to claim 11, wherein:

the channel is of a cylindrical shape.

17. The mat rolling apparatus according to claim 11, wherein:

an outer surface of the two side walls of the tubular body define an arcuate shape, the two side walls of the tubular body having two opposing upper edges defining an entrance aperture with a width spanning the from the distal end of the tubular body to the proximal end of the tubular body, the width of the entrance aperture of a width of two side walls of the channel below the two opposing upper edges.

18. The mat rolling apparatus according to claim 11, wherein:

the open-faced channel spans continuously from the distal end of the tubular body to the proximal end of the tubular body.

* * * * *